US012550952B2

(12) United States Patent
Wan

(10) Patent No.: US 12,550,952 B2
(45) Date of Patent: Feb. 17, 2026

(54) MULTI ZONAL SUPPORT STRUCTURE FOR A BRA CUP AND BRASSIERE

(71) Applicant: Grand Gain Industrial Limited, Hong Kong (HK)

(72) Inventor: Hoyau Wan, Hong Kong (HK)

(73) Assignee: Grand Gain Industrial Limited, Hong Kong (HK)

( * ) Notice: Subject to any disclaimer, the term of this patent is extended or adjusted under 35 U.S.C. 154(b) by 0 days.

(21) Appl. No.: 18/894,181

(22) Filed: Sep. 24, 2024

(65) Prior Publication Data

US 2025/0311795 A1 Oct. 9, 2025

(30) Foreign Application Priority Data

Apr. 3, 2024 (CN) ..... 202420677100.7

(51) Int. Cl.
*A41C 3/14* (2006.01)

(52) U.S. Cl.
CPC ..... *A41C 3/14* (2013.01)

(58) Field of Classification Search
None
See application file for complete search history.

(56) References Cited

U.S. PATENT DOCUMENTS 3,389,446 A * 6/1968 Robert ..... D01D 5/247 28/165
5,388,273 A * 2/1995 Sydor ..... A61F 5/026 2/256
6,645,042 B2 * 11/2003 Davis ..... A41C 3/065 450/82
6,685,535 B2 * 2/2004 Mitchell ..... A41C 3/0007 450/75
6,899,591 B2 * 5/2005 Mitchell ..... A41C 3/0007 450/75
8,075,369 B2 * 12/2011 Hendrickson ..... A41C 3/04 450/86
8,137,155 B2 * 3/2012 Horii ..... A41C 3/005 450/59
8,167,678 B2 * 5/2012 Castellano ..... A41C 3/144 450/39
8,388,406 B2 * 3/2013 Liu ..... A41C 3/12 450/39

(Continued)

FOREIGN PATENT DOCUMENTS

CN 220494307 U * 2/2024
CN 222443199 U * 2/2025

(Continued)

*Primary Examiner* — Grace Huang
(74) *Attorney, Agent, or Firm* — Tucker Ellis LLP

(57) ABSTRACT

A multi zonal support structure for a bra cup and a brassiere are disclosed. The cup partition support structure comprises a first supporting part, a second supporting part and a third supporting part. The first supporting part is adapted to conform to a front side and/or an upper side of a human breast, the second supporting part is arranged adjacent to the first supporting part, and the third supporting part is arranged on a side of the second supporting part away from the first supporting part. The first supporting part has a first hardness a, the second supporting part has a second hardness b and the third supporting part has a third hardness c, where a<b<c.

14 Claims, 3 Drawing Sheets

(56) References Cited

U.S. PATENT DOCUMENTS

| | | | | |
|---|---|---|---|---|
| 8,747,184 | B2 * | 6/2014 | Liu | A41C 3/0007 450/47 |
| 9,737,096 | B2 * | 8/2017 | Hirakubo | A41C 3/14 |
| 9,795,172 | B1 * | 10/2017 | Lee | A41C 3/0021 |
| 11,583,010 | B1 * | 2/2023 | Yarbrough | A41C 3/0057 |
| 11,684,092 | B2 * | 6/2023 | Roddis | A41C 3/0057 2/243.1 |
| 12,096,807 | B2 * | 9/2024 | Choudhury | A41C 3/0021 |
| 2003/0162479 | A1 * | 8/2003 | Tonsor | A41C 3/14 450/54 |
| 2007/0298680 | A1 * | 12/2007 | Martinet | A41C 3/12 450/39 |
| 2014/0242876 | A1 * | 8/2014 | Kitagawa | A41C 1/02 2/243.1 |
| 2017/0215491 | A1 * | 8/2017 | Yuasa | A41C 3/144 |
| 2020/0383389 | A1 * | 12/2020 | Cavosie | A41C 3/0028 |
| 2024/0334990 | A1 * | 10/2024 | Zhang | B32B 5/028 |

FOREIGN PATENT DOCUMENTS

| | | | | |
|---|---|---|---|---|
| JP | 2005023497 | A | * | 1/2005 |
| TW | M458101 | U | * | 8/2013 |

* cited by examiner

MULTI ZONAL SUPPORT STRUCTURE FOR A BRA CUP AND BRASSIERE

CROSS-REFERENCE TO RELATED APPLICATION

This application claims the benefit of Chinese patent application No. 202420677100.7, filed Apr. 3, 2024. The disclosure of Chinese patent application No. 202420677100.7 is hereby incorporated by reference.

TECHNICAL FIELD

The present disclosure relates to the technical field of underwear support, in particular to a multi zonal support structure for a bra cup and a brassiere.

BACKGROUND

Due to structural characteristics of a human breast, the breast has different supporting requirements of different parts of bra cup. Specifically, an upper side and a front side of a human breast need less supporting force, while a bottom side and a side of the human breast need more supporting force. In the existing technologies, the bra cup is often designed in an integrated way, and there is no obvious difference in an overall hardness of the bra cup. If the overall hardness of the bra cup is large and the supporting force is strong, the supporting force of the bra cup corresponding to the upper side and the front side of the human breast will be too large. If the overall hardness of the bra cup is small and the supporting force is weak, the supporting force of the bra cup corresponding to the bottom side and the side of the human breast will be too small. Therefore, it is difficult to meet the requirements of shaping and supporting the human breast, and the overall supporting performance of the bra cup will also decrease. Therefore, the supporting of the bra cup for the breast in the existing technologies is difficult to meet the requirements of different supporting forces in multi-part of the breast, and the supporting performance of the bra cup is poor.

SUMMARY

According to an embodiment of the present disclosure, a multi zonal support structure for a bra cup and a brassiere are provided, which can provide different supporting forces to different parts of a human breast and improve the supporting performance of the bra cup and the brassiere.

In view of this, the present disclosure provides a multi zonal support structure for a bra cup. The support structure includes a first supporting part, a second supporting part and a third supporting part. The first supporting part has a first hardness a. The first supporting part is adapted to conform to a front side of a human breast, and/or, the first supporting part is adapted to conform to an upper side of the human breast. The second supporting part has a second hardness b, and the second supporting part is arranged adjacent to the first supporting part. The third supporting part has a third hardness c, the third supporting part is arranged adjacent to the second supporting part, and the third supporting part is arranged on a side of the second supporting part away from the first supporting part. The first hardness a, the second hardness b and the third hardness c satisfy that: $a<b<c$.

In some embodiments, a direction that the front side of the human breast points to the side of the breast is taken as a first direction, the second supporting part extends in the first direction, the first supporting part is connected to a side of the second supporting part close to the upper side of the human breast, and the third supporting part is connected to a side of the second supporting part close to a bottom side of the breast.

In some embodiments, the direction that the front side of the human breast points to the side of the breast is taken as the first direction, and a second direction is perpendicular to the first direction, the second supporting part extends in the second direction, the first supporting part is connected to a side of the second supporting part close to the front side of the human breast, and the third supporting part is connected to a side of the second supporting part close to the side of the breast.

In some embodiments, the first supporting part has a first toughness d, the second supporting part has a second toughness e, the third supporting part has a third toughness f, and the first toughness d, the second toughness e and the third toughness f satisfy that: $d>e>f$.

In some embodiments, a first part surface is arranged on a side of the first supporting part close to the human body, a second part surface is arranged on a side of the second supporting part close to the human body, and a third part surface is arranged on a side of the third supporting part close to the human body; where, a first area g of the first part surface, a second area h of the second part surface and a third area i of the third part surface satisfy that: $g\leq h\leq i$.

In some embodiments, a first part surface is arranged on a side of the first supporting part close to the human body, a second part surface is arranged on a side of the second supporting part close to the human body, and a third part surface is arranged on a side of the third supporting part close to the human body; where, a first area g of the first part surface, a second area h of the second part surface and a third area i of the third part surface satisfy that: $g\geq h\geq i$.

In some embodiments, a first part surface is arranged on a side of the first supporting part close to the human body, a second part surface is arranged on a side of the second supporting part close to the human body, and a third part surface is arranged on a side of the third supporting part close to the human body; where, a first area g of the first part surface, a second area h of the second part surface and a third area i of the third part surface satisfy that: $g\leq i\leq h$.

In some embodiments, a first part surface is arranged on a side of the first supporting part close to the human body, a second part surface is arranged on a side of the second supporting part close to the human body, and a third part surface is arranged on a side of the third supporting part close to the human body; where, a first area g of the first part surface, a second area h of the second part surface and a third area i of the third part surface satisfy that: $h\leq g\leq i$.

In some embodiments, the structure has a fourth area j, and the first area g, the second area h, the third area i and the fourth area satisfy that: $g+h+i=j$; $g\leq j/4$; $h\geq j/3$; and $i\geq j/3$.

The human breast includes a left human breast and a right human breast. In some embodiments, each of the first supporting part, the second supporting part and the third supporting part is adapted to support the left human breast, and the structure further includes a fourth supporting part, a fifth supporting part and a sixth supporting part each adapted to support the right human breast. The fourth supporting part and the first supporting part are symmetrically arranged along a first axis, the fifth supporting part and the second supporting part are symmetrically arranged along the first axis, the sixth supporting part and the third supporting part are symmetrically arranged along the first axis. A fourth hardness k of the fourth supporting part, a fifth hardness m of the fifth supporting part and a sixth hardness n of the sixth supporting part satisfy that: $k<m<n$.

In some embodiments, the structure further includes a seventh supporting part, the seventh supporting part is adapted to conform to human ribs, the seventh supporting part defines an arc-shaped groove, each of the first supporting part, the second supporting part and the third supporting part is connected to a wall surface of the arc-shaped groove, the seventh supporting part has a seventh hardness p, and the seventh hardness p satisfies that: $p \geq c$.

In some embodiments, the structure further includes an eighth supporting part, the eighth supporting part is arranged on a side of the first supporting part opposite to the seventh supporting part, the eighth supporting part has an eighth hardness q, and the eighth hardness q satisfies that: $q \leq a$.

In some embodiments, the first supporting part is configured as a foam composite material with a first density r, the second supporting part is configured as a foam composite material with a second density s, and the third supporting part is configured as a foam composite material with a third density t, where the first density r, the second density s and the third density t satisfy that: $r \leq s \leq t$.

In some embodiments, the first supporting part is configured as a foam composite material with a first density r, the second supporting part is configured as a foam composite material with a second density s, and the third supporting part is configured as a foam composite material with a third density t, where the first density r, the second density s and the third density t satisfy that: $s \leq r$; and/or, $s \leq t$.

According to a second aspect of the present disclosure, a brassiere is provided. The brassiere includes the structure according to any of the above embodiments.

Compared with the existing technology, the technical schemes of the present disclosure have the beneficial effects as follows.

In the technical schemes of the present disclosure, the hardness of the first supporting part is less than the hardness of the second supporting part and the hardness of the third supporting part, the hardness of the third supporting part is greater than both the hardness of the first supporting part and the hardness of the second supporting part. The third supporting part can provide the largest supporting force for the human breast from the bottom side and/or the side of the human breast. The hardness of the second supporting part is between the hardness of the first supporting part and the hardness of the third supporting part, and a supporting capacity of the second supporting part to the breast is between a supporting capacity of the first supporting part and a supporting capacity of the third supporting part, which provides a transition for the supporting force of the human breast. The first supporting part has the smallest hardness, and the first supporting part provides the smallest supporting force to the breast. According to the technical schemes of the present disclosure, multi-parts adjustable support ability for the human breast is achieved, such that targeted support of the supporting structure for the breast is effectively improved, and supporting performance of the brassiere is greatly improved.

BRIEF DESCRIPTION OF THE DRAWINGS

In order to illustrate the technical schemes in the embodiments of the present disclosure or in the existing technologies more clearly, the drawings used in the description of the embodiments or the existing technologies will be briefly described below. The drawings in the following description are merely some embodiments in the present disclosure. For a person having ordinary skills in the art, other drawings may also be obtained based on these drawings without going through any creative work.

REFERENCE NUMERALS

Figure 1:
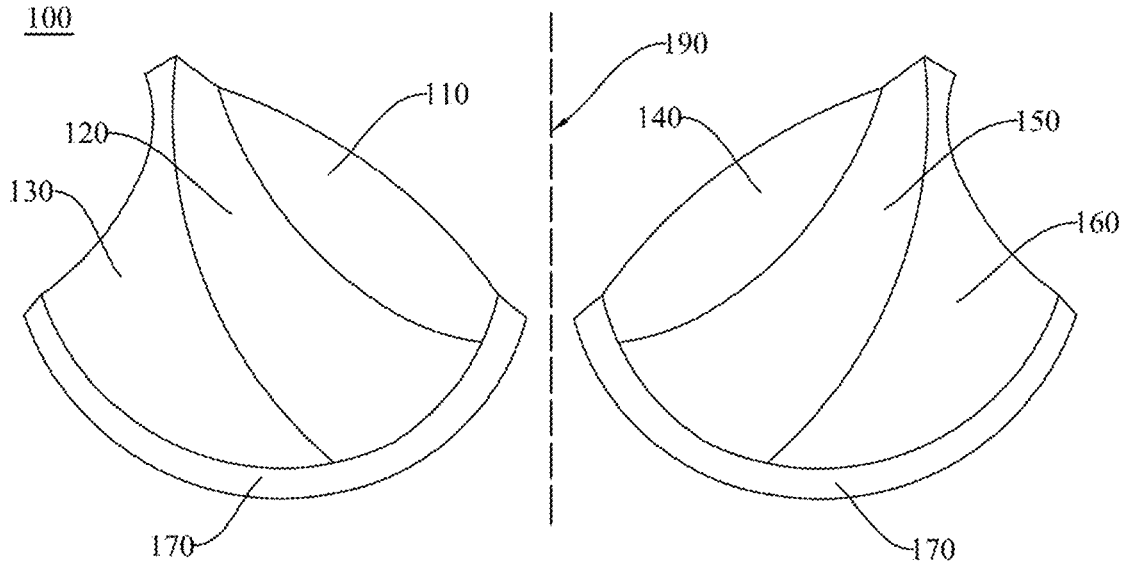
FIG. 1 is a schematic structural diagram of a multi zonal support structure for a bra cup in an embodiment of the present disclosure.

100 refers to multi zonal support structure for a bra cup;
110 refers to first supporting part; and 111 refers to first part surface;
120 refers to second supporting part; 121 refers to first side edge; 122 refers to second side edge; 123 refers to third side edge; 124 refers to fourth side edge; and 125 refers to second part surface;
130 refers to third supporting part; and 131 refers to third part surface;
140 refers to fourth supporting part;
150 refers to fifth supporting part;
160 refers to sixth supporting part;
170 refers to seventh supporting part;
180 refers to eighth supporting part;
190 refers to first axis;
200 refers to brassiere;
X refers to second direction; and
Y refers to first direction.

The implementation, functional features and advantages of the present disclosure will be further described with reference to the attached drawings in combination with the embodiments.

DETAILED DESCRIPTION

The following clearly and completely describes the technical schemes in the embodiments of the present disclosure with reference to the drawings in the embodiments of the present disclosure. Apparently, the described embodiments are merely some but not all of the embodiments of the present disclosure. Based on the embodiments of the present disclosure, all other embodiments obtained by those having ordinary skills in the art without going through any creative work shall fall within the protection scope of the present disclosure.

Due to structural characteristics of a human breast, the breast has different supporting requirements of different parts of a bra cup. Specifically, an upper side and a front side of a human breast need less supporting force, while a bottom side and a side of the human breast need more supporting force. In the existing technologies, the bra cup is often designed in an integrated way, and there is no obvious difference in an overall hardness of the bra cup. If the overall hardness of the bra cup is large and the supporting force is strong, the supporting force of parts of the bra cup corresponding to the upper side and the front side of the human breast will be too large, and the entire supporting performance of the bra cup will be reduced correspondingly. If the overall hardness of the bra cup is small and the supporting force is weak, the supporting force of parts of the bra cup corresponding to the bottom side and the side of the human breast will be too small. Therefore, it is difficult to meet the requirements of shaping and supporting the human breast, and the overall supporting performance of the bra cup will also decrease. Therefore, the bra cup in the existing technologies is difficult to meet the requirements of different supporting forces in various parts of the breast.

In order to at least alleviate the above-mentioned technical problems, as shown in FIG. 1 to FIG. 5, the present disclosure provides a multi zonal support structure for a bra cup 100. The structure 100 includes a first supporting part 110, a second supporting part 120 and a third supporting part 130.

As shown in FIG. 1, the first supporting part 110 has a first hardness a. The first supporting part 110 is adapted to conform to a front side of a human breast, and/or, the first supporting part 110 is adapted to conform to an upper side of the human breast. That is to say, the first supporting part 110 can only conform to and support either the front side or the upper side of the human breast. Alternatively, the first supporting part 110 may also conform to and support both the front side and the upper side of the human breast. In an implementation, the actual division of the front side and the upper side of the human breast may be set according to the design requirements of the bra cup with different versions. It should be noted that "the upper side and the bottom side" in the present disclosure mean that when the human body is upright, one side of the breast close to a head is the upper side, one side of the breast away from the head is the bottom side, the sides that the left breast and the right breast close to each other are the front sides, and the sides that the left breast and the right breast far from each other are the sides.

Figure 2:
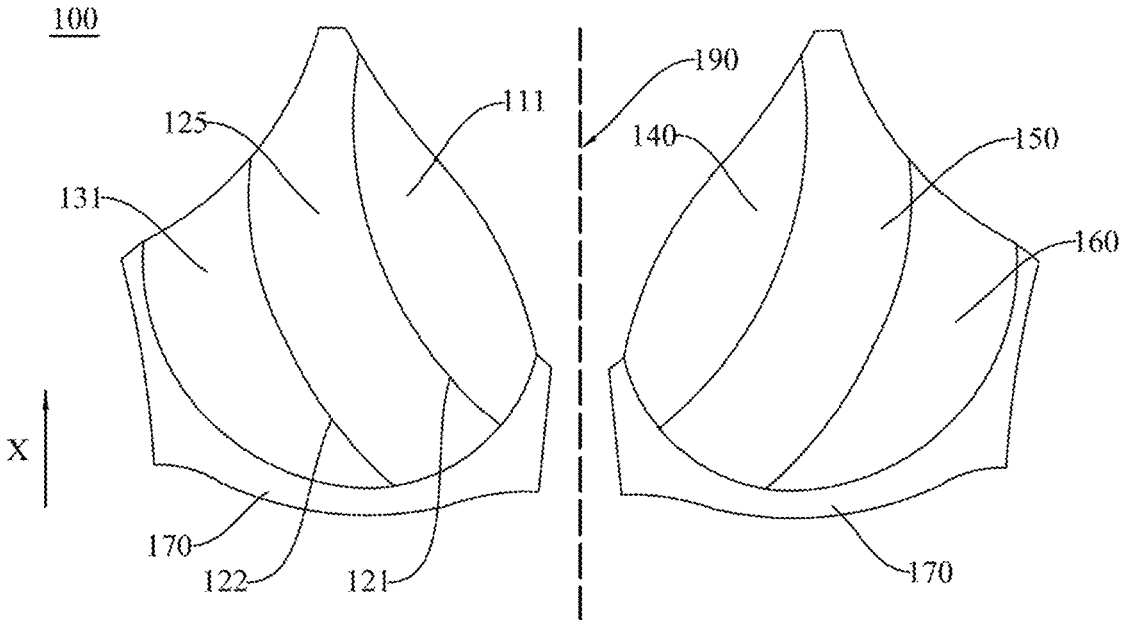
FIG. 2 is a schematic structural diagram of a multi zonal support structure for a bra cup in another embodiment of the present disclosure, where a first side edge extends in a second direction.

As shown in FIG. 2, the second supporting part 120 has a second hardness b, and the second supporting part 120 is arranged adjacent to the first supporting part 110. In an implementation, the second supporting part 120 is arranged on a side of the first supporting part 110 away from the front side of the human breast. In another implementation, the second supporting part 120 is arranged on a side of the first supporting part 110 away from the upper side of the human breast. The second supporting part 120 has a side edge connected with the first supporting part 110, and the side edge of the second supporting part 120 connected with the first supporting part 110 may be a straight, arched, wavy boundary, or a boundary with any suitable shape, which may be different according to the different parts of the breast that the first supporting part 110 and the second supporting part 120 need to support.

Figure 3:
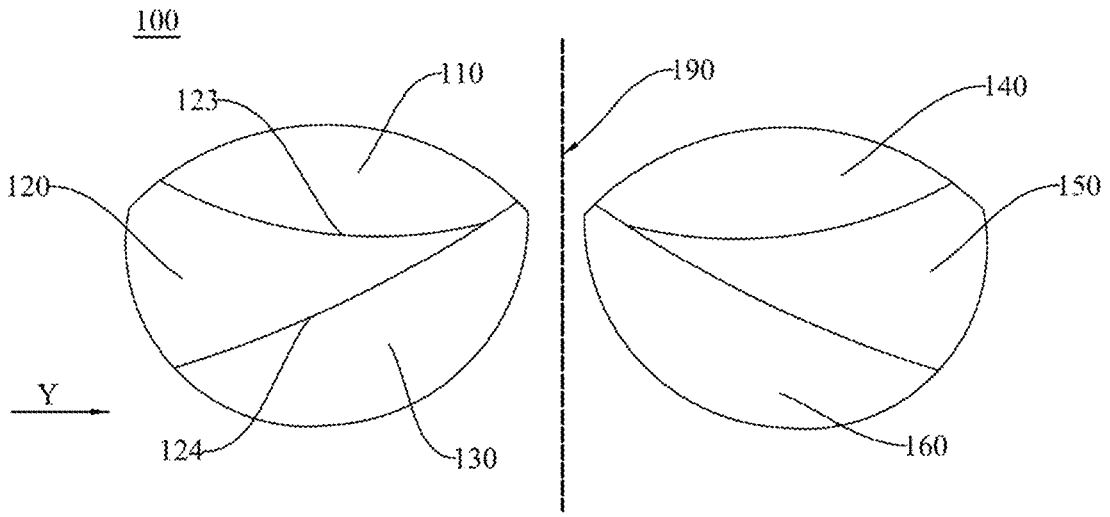
FIG. 3 is a schematic structural diagram of a multi zonal support structure for a bra cup in another embodiment of the present disclosure, where a third side edge extends in a first direction.

As shown in FIG. 3, the third supporting part 130 has a third hardness c. The third supporting part 130 is arranged adjacent to the second supporting part 120, and the third supporting part 130 is arranged on one side of the second supporting part 120 away from the first supporting part 110. In an implementation that the first supporting part 110 is adapted to conform to the upper side of the human breast, the third supporting part 130 is adapted to conform to the bottom side of the human breast. In an implementation that the first supporting part 110 is adapted to conform to the front side of the human breast, the third supporting part 130 is adapted to conform to the side of the human breast. Taking a left human breast as an example, if the first supporting part 110 is adapted to conform to an upper side of the left human breast and the front side of the left human breast closes to the right human breast, the third supporting part 130 is adapted to conform to a bottom side of the left human breast and a side of the left human breast away from the right human breast. Similarly, the third supporting part 130 has a side edge connected with the second supporting part 120. In some embodiments, the third supporting part 130 may further have a side edge connected with the first supporting part 110. Shapes of the side edges of the third supporting part 130 connected with the second supporting part 120 and the first supporting part 110 may also be different according to the division of the supporting parts of the third supporting part 130, which will not be described here.

In the technical scheme of the present disclosure, the first supporting part 110 is adapted to conform to the front side of the human breast, and/or, the first supporting part 110 is adapted to conform to the upper side of the human breast. The second supporting part 120 is arranged adjacent to the first supporting part 110, the third supporting part 130 is arranged adjacent to the second supporting part 120, and the third supporting part 130 is arranged on one side of the second supporting part 120 away from the first supporting part 110. The first supporting part 110 has a first hardness a, the second supporting part 120 has a second hardness b, and the third supporting part 130 has a third hardness c, where the first hardness a, the second hardness b and the third hardness c satisfy that: $a<b<c$. It can be understood that the first hardness a may be any suitable proportion, such as 80%, 70% or 40%, of the second hardness b. The second hardness b may be any suitable proportion, such as 82%, 68% or 45%, of the third hardness c. The hardness of the first supporting part 110 is less than the hardness of the second supporting part 120 and the hardness of the third supporting part 130, and the hardness of the third supporting part 130 is greater than both the hardness of the first supporting part and the hardness of the second supporting part 120. Therefore, the third supporting part 130 can provide the strongest support for the human breast from the bottom side and/or the side. The hardness of the second supporting part 120 is between the hardness of the first supporting part 110 and the hardness of the third supporting part 130, and the supporting capacity of the second supporting part 120 on the breast is between a supporting capacity of the first supporting part 110 and a supporting capacity of the third supporting part 130, which provides a transition for supporting the human breast. The first supporting part 110 has the smallest hardness, and the first supporting part 110 also provides the smallest supporting force to the breast. According to the technical scheme of the present disclosure, multi zonal support to the human breast is achieved, such that targeted support of the support structure to support the breast is effectively improved, and the supporting performance of the brassiere is greatly improved.

According to different part supporting requirements, the relative division of the first supporting part 110, the second supporting part 120 and the third supporting part 130 is arbitrary. As shown in FIG. 3, in some embodiments, a direction that the front side of the human breast points to a side of the human breast is taken as a first direction Y, the second supporting part 120 extends in the first direction Y, the first supporting part 110 is connected to one side of the second supporting part 120 close to the upper side of the human breast, and the third supporting part 130 is connected to one side of the second supporting part 120 close to a bottom side of the breast. As shown in FIG. 2, in some embodiments, the direction that the front side of the human breast points to the side is taken as the first direction Y, and a second direction X is perpendicular to the first direction Y, the second supporting part 120 extends in the second direction X, the first supporting part 110 is connected to one side of the second supporting part 120 close to the front side of the human breast, and the third supporting part 130 is connected to a side of the second supporting part 120 close to the side of the breast.

Figure 4:
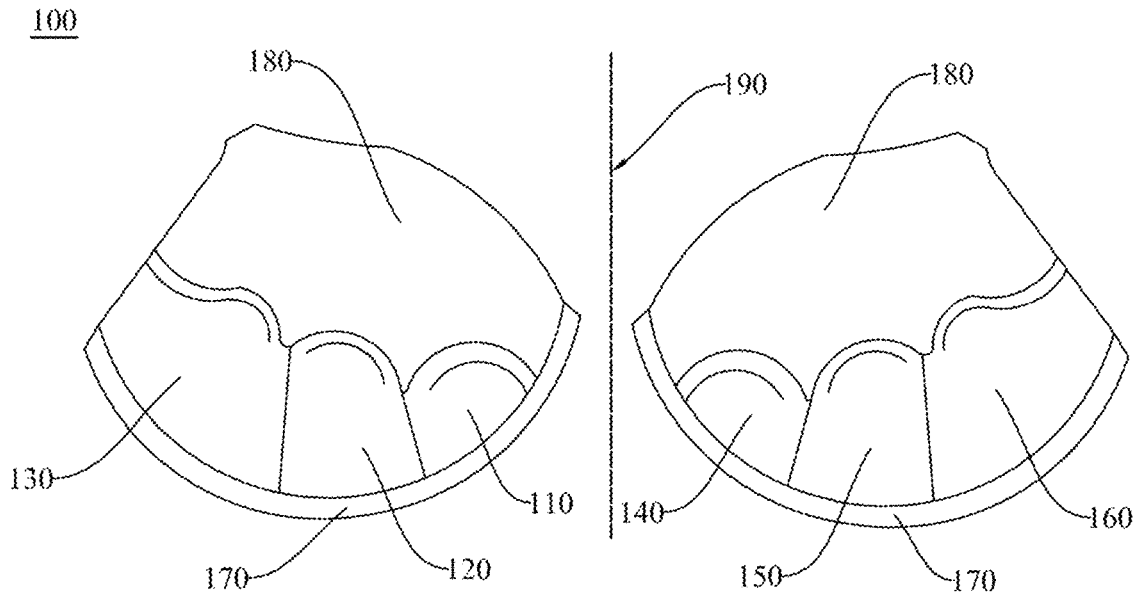
FIG. 4 is a schematic structural diagram of a multi zonal support structure for a bra cup in yet another embodiment of the present disclosure, where the structure includes a seventh supporting part and an eighth supporting part.

As shown in FIG. 1 and FIG. 2, in some embodiments, taking the vertical direction as the second direction X, the second supporting part 120 has a first side edge 121 and a second side edge 122 extending in the second direction X. The first side edge 121 is arranged on a side of the second supporting part 120 close to the front side of the breast and connected with the first supporting part 110, while the second side edge 122 is arranged on a side of the second supporting part 120 close to the side of the breast and connected with the third supporting part 130. That is to say, the first supporting part 110, the second supporting part 120 and the third supporting part 130 may extend in the vertical direction and divide the structure 100 into three supporting parts in the vertical direction. It should be noted that, as shown in FIG. 4, extension lengths of the first supporting part 110, the second supporting part 120 and the third supporting part 130 on the bra cup in the vertical direction may be different according to the design requirements of the bra cup. The first supporting part 110, the second supporting part 120, and the third supporting part 130 may cover the whole cup, or only cover ½ or ⅔ of the length of the bra cup in the vertical direction, and which is not limited here. As shown in FIG. 3, in some embodiments, taking the horizontal direction as the first direction Y, the second supporting part 120 has a third side edge 123 and a fourth side edge 124 extending in the first direction Y. The third side edge 123 is arranged on a side of the second supporting part 120 close to the upper side of the human breast and connected with the first supporting part 110. The fourth side edge 124 is arranged on a side of the second supporting part 120 close to the bottom side of the human breast and connected with the third supporting part 130. That is to say, the first supporting part 110, the second supporting part 120 and the third supporting part 130 may be divided in the vertical direction or in the horizontal direction, which may be specifically selected according to the design requirements of the bra cup. It should be noted that when the first supporting part 110, the second supporting part 120 and the third supporting part 130 are divided in the vertical direction or in the horizontal direction, boundaries between the first supporting part 110 and the second supporting part 120, and between the second supporting part 120 and the third supporting part 130 may be straight or curved, the boundary between the first supporting part 110 and the second supporting part 120 may be parallel to or intersect with the boundary between the second supporting part 120 and the supporting part 130, and which is not limited here. It should be noted that when the first supporting part 110 and the third supporting part 130 are spliced with the second supporting part 120, the first side edge 121, the second side edge 122, the third side edge 123 or the fourth side edge 124 may all be obtained by cutting. The first supporting part 110 and the third supporting part 130 may also be integrally formed with the second supporting part 120 by molding, and the division of the first side edge 121, the second side edge 122, the third side edge 123 and the fourth side edge 124 here are for the convenience of description of the product, but not restrictions on each part of the product which has to be provided with corresponding side edges. In order to further improve the comfort of the structure 100, the first supporting part 110, the second supporting part 120 and the third supporting part 130 may also have different toughness. In some embodiments, the first supporting part 110 has a first toughness d, the second supporting part 120 has a second toughness e, the third supporting part 130 has a third toughness f, and the first toughness d, the second toughness e and the third toughness f satisfy that: $d>e>f$. In an implementation, the first toughness d may be any suitable multiple, such as 1.1 multiples, 1.3 multiples or 2.1 multiples, of the second toughness e. The second toughness e may be any suitable multiple, such as 1.2 multiples, 1.5 multiples or 2.1 multiples, of the third toughness f.

According to different supporting requirements, the area division of the first supporting part 110, the second supporting part 120 and the third supporting part 130 may also be different. As shown in FIG. 2, in some embodiments, an inner side of the first supporting part 110 close to the human body has a first part surface 111, an inner side of the second supporting part 120 close to the human body has a second part surface 125, and an inner side of the third supporting part 130 close to the human body has a third part surface 131. A first area g of the first part surface 111, a second area h of the second part surface 125 and a third area i of the third part surface 131 satisfy that: $g \le h \le i$. In an embodiment, the structure 100 has a fourth area j, and the first area g, the second area h, the third area i and the fourth area satisfy that: $g+h+i=j$; $g \le j/4$; $h \le j/3$; and $i \ge j/3$. In an implementation, the first area may account for ¼, ⅕ or ⅙ of the total area, the second area may be ⅓ or ¾ of the total area, and the third area may be ⅓ or ¾ of the total area. The first area is smaller than the second area and the third area, and the first area is no more than ¼ of the total area, such that the structure 100 can provide good support for the breast and have good supporting performance at the same time.

In some embodiments, relative sizes of the first area g, the second area h and the third area i may also be different according to the different design requirements of the bra cup. The first area g may be greater than the second area h, or may also be smaller than the second area h. Likely, the third area i may be greater than the second area h, or may also be smaller than the second area h. In the three areas, the largest area can be any one of the three areas, and likely, the smallest area may also be any one of the three areas. In an implementation, the first area g, the second area h and the third area i may satisfy one of that: $g \ge h \ge i$, or $g \le i \le h$, or $h \le g \le i$, which will not be described here.

In some embodiments, according to different design requirements of brassiere, both left and right bra cups of the brassiere may be provided with a structure 100. In an embodiment, as shown in FIG. 3, each of the first supporting part 110, the second supporting part 120 and the third supporting part 130 is adapted to support the left human breast, and the structure 100 further includes a fourth supporting part 140, a fifth supporting part 150 and a sixth supporting part 160 each adapted to support the right human breast. The fourth supporting part 140 and the first supporting part 110 are symmetrically arranged along a first axis 190, the fifth supporting part 150 and the second supporting part 120 are symmetrically arranged along the first axis 190, the sixth supporting part 160 and the third supporting part 130 are symmetrically arranged along the first axis 190. A fourth hardness k of the fourth supporting part 140, a fifth hardness m of the fifth supporting part 150 and a sixth hardness n of the sixth supporting part 160 satisfy that: $k<m<n$. The fourth supporting part 140, the fifth supporting part 150, and the sixth supporting part 160 may have part-division settings similar to those of the first supporting part 110, the second supporting part 120, and the third supporting part 130, which are not described in detail here.

In some embodiments, in order to further improve the supporting capacity, the structure can conform not only to the human breast, but also to human ribs. As shown in FIG. 1 and FIG. 2, in some embodiments, the structure 100 further includes a seventh supporting part 170, which is adapted to conform to the human ribs. The seventh supporting part 170 defines an arc-shaped groove, and the first supporting part 110, the second supporting part 120 and the third supporting part 130 are connected to a wall surface of the arc-shaped groove. The seventh supporting part 170 has a seventh hardness p, and the seventh hardness p satisfies that: $p \geq c$. In an implementation, the seventh hardness p may be any suitable multiple, such as 1.1 multiples and 1.3 multiples, of the third hardness c.

Similarly, in order to further improve the supporting performance, an eighth supporting part 180 may be further arranged on a part of the bra cup close to the upper side of the breast. In an embodiment, as shown in FIG. 4, the structure 100 further includes the eighth supporting part 180. The eighth supporting part 180 is arranged on a side of the first supporting part 110 opposite to the seventh supporting part 170. The eighth supporting part 180 has an eighth hardness q, and the eighth hardness q satisfies that: $q \leq a$. The eighth hardness q may be 60% or 80% of the first hardness.

In the manufacturing process, the first supporting part 110, the second supporting part 120 and the third supporting part 130 may be made of different materials to realize the change of toughness and hardness in each part, and the change of toughness and hardness in each part can also be realized by controlling different usage and compaction density of the same material in each part. In some embodiments, the first supporting part 110 is configured as a foam composite material with a first density r, the second supporting part 120 is configured as a foam composite material with a second density s, and the third supporting part 130 is configured as a foam composite material with a third density t, where the first density r, the second density s and the third density t satisfy that: $r \leq s \leq t$. In an embodiment, the first density r, the second density s and the third density t satisfy that: $r \leq 0.8s \leq 0.8t$. It can be understood that the first supporting part 110, the second supporting part 120 and the third supporting part 130 may be molded. Before molding, the material density of each part may be the same, but the material thickness used in each part may be different, such that the part with larger material thickness after molding has a higher density, and has a higher hardness and stronger supporting ability accordingly.

In order to make an elasticity of the second supporting part 120 greater than an elasticity of the first supporting part 110 and an elasticity of the third supporting part 130, and enhance side supporting effects of the first supporting part 110 and the third supporting part 130, in some embodiments, the first density r, the second density s and the third density t satisfy that: $s \leq r$; and/or, $s \leq t$.

Figure 5:
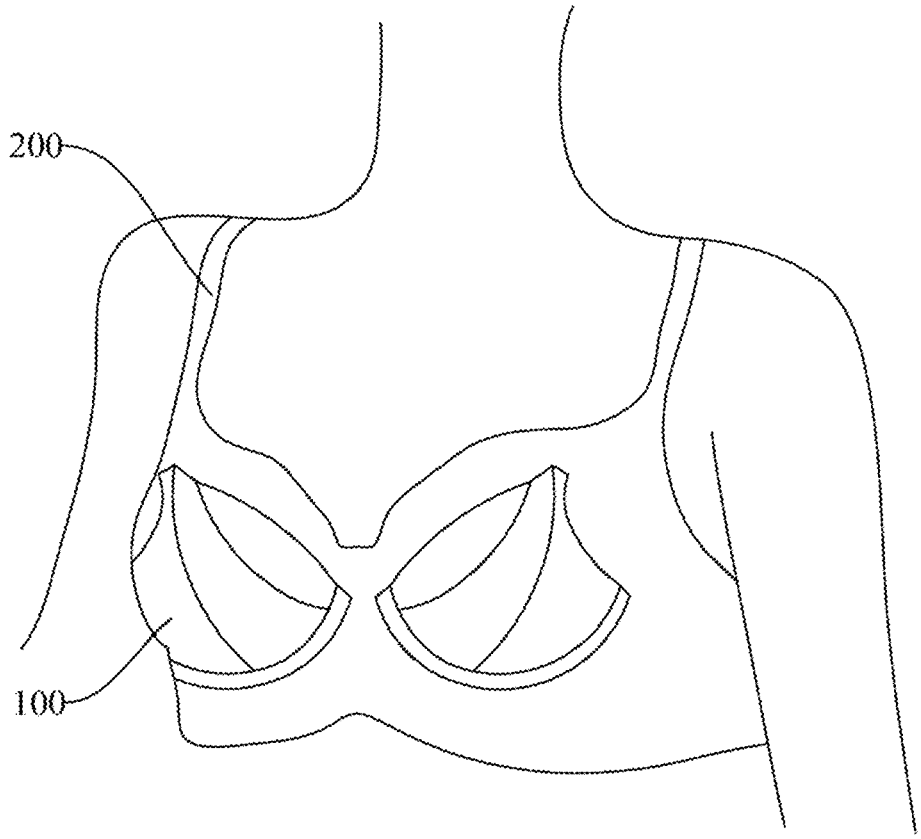
FIG. 5 is a schematic structural diagram of a brassiere according to an embodiment of the present disclosure.

The embodiments of the present disclosure also provide a brassiere 200. As shown in FIG. 5, the brassiere includes the structure 100 according to any of the above embodiments. Thanks to the improvement of the above-mentioned structure 100, the brassiere 200 of this embodiment has the same technical effect as the above-mentioned structure 100, which is not repeated here. In some embodiments, the seventh supporting part 170 and the eighth supporting part 180 in the brassiere 200 may be configured as underwires, made of the same material as the first supporting part 110, the second supporting part 120 and the third supporting part 130, or made of any other suitable material such as cloth.

It should be noted that when there are directional indications (such as upper, bottom, left, right, front, back, and the like) in the embodiments of the present disclosure, the directional indications are only used to explain the relative positional relationships and movement situations between components in a certain posture (as shown in the attached drawings). If the specific posture changes, the directional indications will also change accordingly.

Moreover, if there are descriptions about "first", "second" and the like in the embodiments of the present disclosure, the descriptions about "first", "second" and the like are intended to distinguish different objects, and cannot be understood as indicating or implying relative importance, or implicitly indicating the number of the indicated technical features. Therefore, the features defined with "first" and "second" can explicitly or implicitly include at least one of the features. In addition, "and/or" appearing in the whole text means three parallel schemes, for example, "A and/or B" means the scheme that A satisfies, the scheme that B satisfies or the scheme that both A and B satisfy. In addition, the technical schemes of various embodiments may be combined with each other, but have to be based on what those having ordinary skills in the art can achieve. When the combination of the technical schemes is contradictory or impossible to realize, it should be considered that the combination of such technical schemes does not exist and is not within the scope of protection claimed by the present disclosure.

The foregoing descriptions are some embodiments of the present disclosure, but are not intended to limit the patent scope of the present disclosure. All equivalent structure variations made using the description of the present disclosure and the accompanying drawings, or being employed directly or indirectly in other related technical fields, shall be included in the protection scope of the present disclosure.

What is claimed is:

1. A multi zonal support structure for a bra cup, comprising:

a first supporting part having a first hardness a, wherein the first supporting part is adapted to conform to a front side of a human breast;

a second supporting part having a second hardness b, wherein the second supporting part is arranged adjacent to the first supporting part;

a third supporting part having a third hardness c, wherein the third supporting part is arranged adjacent to the second supporting part; and an upper supporting part having a hardness q, the upper supporting part is arranged above the first supporting part, the second supporting part and the third supporting part; and wherein the hardness q, the first hardness a, the second hardness b and the third hardness c satisfy that: $q<a<b<c$.

2. The structure according to claim 1, wherein:

a direction that the front side of the human breast points to the side of the human breast is taken as a first direction, and a second direction is perpendicular to the first direction, the second supporting part extends in the second direction, the first supporting part is connected to a side of the second supporting part close to the front side of the human breast, the third supporting part is connected to a side of the second supporting part close to the side of the human breast, and the upper supporting part extends in the first direction.

3. The structure according to claim 1, wherein:

a first part surface is arranged on an inner side of the first supporting part close to a human body, a second part surface is arranged on an inner side of the second supporting part close to the human body, and a third part surface is arranged on an inner side of the third supporting part close to the human body;

wherein, a first area g of the first part surface, a second area h of the second part surface and a third area i of the third part surface satisfy one of: $g \leq h \leq i$, $g \geq h \geq i$; $g \leq i \leq h$; or $h \leq g \leq i$.

4. The structure according to claim 3, wherein:

the structure has a fourth area j, and the first area g, the second area h, the third area i and the fourth area satisfy that: $g+h+i \geq j$.

5. The structure according to claim 1, wherein: the bra cup comprises a left cup portion for a left human breast and a right cup portion for a right human breast, wherein, the left cup portion comprises the first supporting part, the second supporting part and the third supporting part, each of which is adapted to support the left human breast, and the right cup portion further comprises a fourth supporting part, a fifth supporting part and a sixth supporting part each adapted to support the right human breast, the fourth supporting part and the first supporting part are symmetrically arranged along a first axis, the fifth supporting part and the second supporting part are symmetrically arranged along the first axis, the sixth supporting part and the third supporting part are symmetrically arranged along the first axis, and a fourth hardness k of the fourth supporting part, a fifth hardness m of the fifth supporting part and a sixth hardness n of the sixth supporting part satisfy that: $k<m<n$.

6. The structure according to claim 1, wherein:

the structure further comprises a lower supporting part, the lower supporting part is adapted to conform to human ribs, the lower supporting part defines an arc-shaped groove, each of the first supporting part, the second supporting part and the third supporting part is connected to a wall surface of the arc-shaped groove, the lower supporting part has a further hardness p, and the further hardness p satisfies that: $p \geq c$.

7. The structure according to claim 1, wherein:

the first supporting part is configured as a foam composite material with a first density r, the second supporting part is configured as a foam composite material with a second density s, and the third supporting part is configured as a foam composite material with a third density t;

wherein:

the first density r, the second density s and the third density t satisfy that: $r \leq s \leq t$, or, the first density r, the second density s and the third density t satisfy at least one of: $s \leq r$; or $s \leq t$.

8. A brassiere, comprising a multi zonal support structure for a bra cup, wherein, the structure comprises a first supporting part having a first hardness a, wherein the first supporting part is adapted to conform to a front side of a human breast;

a second supporting part having a second hardness b, wherein the second supporting part is arranged adjacent to the first supporting part;

a third supporting part having a third hardness c, wherein the third supporting part is arranged adjacent to the second supporting part; and an upper supporting part having a hardness q, the upper supporting part is arranged above the first supporting part, the second supporting part and the third supporting part; and wherein the hardness q, the first hardness a, the second hardness b and the third hardness c satisfy that: $g<a<b<c$.

9. The brassiere according to claim 8, wherein:

a direction that the front side of the human breast points to the side of the human breast is taken as the first direction, and a second direction is perpendicular to the first direction, the second supporting part extends in the second direction, the first supporting part is connected to a side of the second supporting part close to the front side of the human breast, the third supporting part is connected to a side of the second supporting part close to the side of the human breast, and the upper supporting part extends in the first direction.

10. The brassiere according to claim 8, wherein:

a first part surface is arranged on an inner side of the first supporting part close to a human body, a second part surface is arranged on an inner side of the second supporting part close to the human body, and a third part surface is arranged on an inner side of the third supporting part close to the human body;

wherein, a first area g of the first part surface, a second area h of the second part surface and a third area i of the third part surface satisfy one of: $g \leq h \leq i$, $g \geq h \geq i$, $g \leq i \leq h$; or $h \leq g \leq i$.

11. The brassiere according to claim 10, wherein:

the structure has a fourth area j, and the first area g, the second area h, the third area i and the fourth area satisfy that: $g+h+i \leq j$.

12. The brassiere according to claim 8, wherein: the bra cup comprises a left cup portion for a left human breast and a right cup portion for a right human breast, wherein, the left cup portion comprises the first supporting part, the second supporting part and the third supporting part, each of which is adapted to support the left human breast, and the right cup portion comprises a fourth supporting part, a fifth supporting part and a sixth supporting part each adapted to support the right human breast, the fourth supporting part and the first supporting part are symmetrically arranged along a first axis, the fifth supporting part and the second supporting part are symmetrically arranged along the first axis, the sixth supporting part and the third supporting part are symmetrically arranged along the first axis, and a fourth hardness k of the fourth supporting part, a fifth hardness m of the fifth supporting part and a sixth hardness n of the sixth supporting part satisfy that: $k<m<n$.

13. The brassiere according to claim 8, wherein:

the structure further comprises a lower supporting part, the lower supporting part is adapted to conform to human ribs, the lower supporting part defines an arc-shaped groove, each of the first supporting part, the second supporting part and the third supporting part is connected to a wall surface of the arc-shaped groove, the lower supporting part has a further hardness p, and the further hardness p satisfies that: $p \geq c$.

14. The brassiere according to claim 8, wherein:

the first supporting part is configured as a foam composite material with a first density r, the second supporting part is configured as a foam composite material with a second density s, and the third supporting part is configured as a foam composite material with a third density t;

wherein:

the first density r, the second density s and the third density t satisfy that: $r \leq s \leq t$;

or, the first density r, the second density s and the third density t satisfy at least one of: $s \leq r$; or $s \leq t$.

* * * * *